United States Patent [19]

Stevens et al.

[11] 4,066,517

[45] Jan. 3, 1978

[54] ELECTRODEPOSITION OF PALLADIUM

[75] Inventors: Peter Stevens, Parsippany; John M. Deuber, Nutley, both of N.J.

[73] Assignee: Oxy Metal Industries Corporation, Warren, Mich.

[21] Appl. No.: 666,093

[22] Filed: Mar. 11, 1976

[51] Int. Cl.[2] ..... C25D 3/52; C25D 3/56

[52] U.S. Cl. ..... 204/43 N; 204/44; 204/47

[58] Field of Search ..... 204/47, 43 N, 44

[56] References Cited

U.S. PATENT DOCUMENTS 3,925,170 12/1975 Skomoroski et al. ..... 204/43 N 3,933,602 1/1976 Henzi et al. ..... 204/44

*Primary Examiner*—G. L. Kaplan

*Attorney, Agent, or Firm*—B. F. Claeboe; Richard P. Mueller; Arthur E. Kluegel

[57] ABSTRACT

Disclosed is a palladium electroplating bath and a method of plating therewith. The bath contains palladium as the palladosammine chloride and a phosphonic compound which is an alkylene diamine phosphonate derivative. The bath may be employed to plate palladium or its alloys. In a preferred embodiment, a pure palladium deposit may be obtained which exhibits very low porosity even after subsequent cold forming of the article on which it is deposited.

12 Claims, No Drawings

ELECTRODEPOSITION OF PALLADIUM

BACKGROUND OF THE INVENTION

This invention relates to the art of electroplating palladium and its alloys. Numerous plating baths have been proposed for this purpose. Typical baths are taught, for example, in U.S. Pat. Nos. 1,921,941; 3,150,065; 3,162,512; 3,206,382; 3,458,409; 3,530,050; 3,544,345; 3,637,474; and 3,933,602. The foregoing patents discuss systems containing, for example, palladium di- and tetrammine halides, palladium-urea sulfite complexes, palladium dinitrile complexes, palladium tetrammine nitrate or sulfate complexes and palladium amine sulfite complexes. The possible use of an alkylene diamine phosphonate derivative in conjunction with a palladium sulfite complex has been suggested, for example, in the last above mentioned patent.

It would be desired to have available an electroplating bath which, when employed for the deposition of pure palladium, would yield a deposit which may be subsequently cold formed without destroying the integrity of the electrodeposited coating. The coating must continue to exhibit acceptable low porosity and good adhesion even after cold forming. Toward this end it is desired that the bath be resistant to hydrogen formation since hydrogen generated would be adsorbed by the palladium deposit embrittling the deposit and thereby degrading the post-formability of the palladium coating. It would also be desirable to have available in the art a palladium electroplating bath which may be employed for deposition on iron, cobalt or nickel substrates which are normally passivated under alkaline conditions.

SUMMARY OF THE INVENTION

It has now been discovered that an aqueous bath containing palladosammine chloride and a phosphonic compound of the formula:

$$[(MO)_2-\overset{\overset{\displaystyle O}{\|}}{P}-R']_2-N-R-N-[R'-\overset{\overset{\displaystyle O}{\|}}{P}-(OM)_2]_2$$

wherein R is an alkylene group of 2 – 6 carbon atoms, each R′ is an alkylene group of 1 to 4 carbon atoms, and each M is a non-deleterious cationic moiety is stable and can be utilized to accomplish the foregoing purposes.

DETAILED DESCRIPTION OF THE INVENTION

The palladium is supplied to the electroplating bath of the present invention in the form of the palladosammine chloride having the formula $Pd(NH_3)_2Cl_2$. Apparently the ammine complex maintains the palladium ion soluble in the solution and available for electrolytic deposition, and the chloride ion helps promote conductivity of the solution thereby minimizing the production of hydrogen and consequent degradation of the desired properties of the palladium coating. The palladium content of the plating bath will normally be in the range of 0.1 to 50 g/l. For obtaining a strike plate a concentration of 1 to 5 g/l is preferred and for ordinary plating a concentration of from 5 to 15 g/l and most preferably about 10 g/l is preferred.

The phosphonic compound employed in the electroplating bath is an alkylene diamine derivative having the formula;

$$[(MO)_2-\overset{\overset{\displaystyle O}{\|}}{P}-R']_2-N-R-N-[R'-\overset{\overset{\displaystyle O}{\|}}{P}-(OM)_2]_2$$

wherein R is an alkylene group of 2 – 6 carbon atoms, each R′ is an alkylene group of 1 to 4 carbon atoms, and each M is a non-deleterious cationic moiety. The non-deleterious cationic moiety may be any cation portion which does not interfere with the electroplating process. Suitable examples include hydrogen, alkali metals, ammonium, magnesium and the like. The compound may also be an esterified form of the alkylene diamine derivative wherein the M groups are alkyl groups of from 1 to 6 carbon atoms. The phosphonic compound is thought to act as a conductive salt, a buffering compound, and a complexing agent for extraneous multivalent ions which it is not desired to plate out. The concentration of the phosphonic compound should be from 5 g/l up to the solubility limit of the solution. Preferably, the concentration will be between 25 and 100 g/l. Dequest 2041 is a trademarked product of Monsanto Co. for ethylene diamine tetra(methylphosphonic acid) which contains approximately 10% water.

The pH of the electroplating solution should be maintained at a value of from 4.5 to 12 in order to avoid stability problems. Values of from about 4.5 to 7.0 are preferred for strike plating with a value of about 6.5 being most preferred. For ordinary electroplating, a pH value of from about 7 to 10 is preferred with value of about 8.0 to 9.0 being most preferred.

The adjustment of the pH value is most readily accomplished through the addition of either ammonium hydroxide or hydrochloric acid. The use of ammonium hydroxide helps promote the stability of the palladium ammine complex while the use of hydrochloric acid helps promote conductivity of the solution thereby minimizing hydrogen generation at the cathode. Other commonly used non-deleterious pH adjusting agents may be employed, but the foregoing are preferred because of their dual function.

To further reduce the likelihood of hydrogen formation at the cathode, it is generally desired to include additional quanities of a conductive salt. Any of the commonly used conductive salts commonly employed in palladium electroplating may be used in the present bath, but the preferred conductive salt is ammonium chloride. Again, the presence of ammonium promotes the stability of the palladium ammine complex whereas the chloride anion promotes conductivity of the solution. Additional compounds may be employed for their conducting or buffering capacity, such as the partially neutralized phosphate compounds. One compound found specifically useful is ammonium monohydrogen phosphate.

The present bath may also be modified to include additives such as brighteners, alloying elements and chelating agents. Suitable brightening agents include the organic nickel brighteners, as well as the transition metals, such as cadmium, copper, gallium, indium, tellurium, arsenic and zinc. Suitable alloying elements include nickel, cobalt and iron. Suitable chelating or sequestering agents include the carboxylic acid chelating agents such as EDTA, NTA and the citrates. Polyalkyl polyamines such as diethylene triamine may be added as well.

The temperature of the palladium bath may be maintained between room temperature and 160° F. The preferred temperature will be less than 130° F in order to avoid the emission of excess ammonia from the solution. Current densities of from 0.1 to 50 ASF are suitable. For rack plating, a current density of from 5 to 15 and most preferably about 10 ASF may be employed. For barrel plating, the preferred range is from 0.5 to 3 ASF.

If a low stress deposit is desired, one of the conventional stress reducing agents such as sulfamic acid, its salts or derivatives may be employed. Concentrations up to 100 g/l are suitable with concentrations of from 25 to 75 g/l being preferred.

Preferred baths according to the invention are as follows:

| Component | Concentration |
|---|---|
| Ethylene diamine tetra-(methylphosphonic acid) | 5 g/l to solubility limit |
| $Pd(NH_3)_2Cl_2$ | 0.1 to 50 g/l |
| Sulfamic acid | 1 to 100 g/l |
| Ammonium chloride | 1 to 200 g/l |
| Ammonium monohydrogen phosphate | 1 to 100 g/l |
| Ammonium hydroxide | to pH 4.5 to 12 |

Most preferred parameters are as follows:

| Component | Concentration |
|---|---|
| Ethylene diamine tetra-(methylphosphonic acid) | 45 g/l |
| $Pd(NH_3)_2Cl_2$ | 1 to 10 g/l |
| Sulfamic acid | 40 g/l |
| Ammonium chloride | 50 to 150 g/l |
| Ammonium monohydrogen phosphate | 25 to 75 g/l |
| Ammonium hydroxide | to pH 6.5 to 10 |

The following examples will serve to illustrate the invention:

EXAMPLE 1

An aqueous palladium electroplating bath was prepared as follows:

| Component | Concentration - g/l |
|---|---|
| $Pd(NH_3)_2Cl_2$ | 10 as Pd |
| Sulfamic acid | 40 |
| Dequest 2041 | 50 |
| $NH_4OH$ | to pH 9.0 |

Plating was performed directly on steel panels at a temperature of 100° F and a current density of 10 ASF. The deposit obtained exhibited good adherence to the substrate surface. When comparative plating tests are run both without the phosphonate or with EDTA as a substitute, visibly poor adhesions are obtained.

Similar results were observed at 20 ASF.

EXAMPLE 2

An aqueous palladium electroplating bath was prepared to contain:

| Component | Concentration - g/l |
|---|---|
| $Pd(NH_3)_2Cl_2$ | 10 as Pd |
| Sulfamic acid | 40 |
| Dequest 2041 | 50 |
| $(NH_4)_2HPO_2$ | 60 |
| $NH_4Cl$ | 50 |
| $NH_4OH$ | to pH 8.5 |

Plating was performed on brass panels for 60 minutes at a temperature of 120° F and a current density of 10 ASF. The bath produced a deposit exhibiting good adhesion and the bath exhibited no instability. When 50 g/l of Dequest 2010 (1-hydroxyethylidene-1,1 di-phosphonic acid) was substituted for the Dequest 2041, the bath decomposed after plating for 10 minutes.

EXAMPLE 3

An aqueous palladium electroplating path was prepared to contain:

| Component | Concentration - g/l |
|---|---|
| $Pd(NH_3)_2Cl_2$ | 2 as Pd |
| Dequest 2041 | 50 |
| $NH_4Cl$ | 100 |
| $NH_4OH$ | to pH 4.5 |

Strike plating was performed on brass panels at 120° F, 1.5 ASF for 5 minutes. A palladium deposit was obtained which exhibited good adhesion and could be further plated with the bath of Example 2 to yield low porosity, ductile, and malleable deposits of good adhesion.

EXAMPLE 4

An aqueous palladium-nickel plating bath was prepared as follows:

| Component | Concentration - g/l |
|---|---|
| $Pd(NH_3)_2Cl_2$ | 10 as Pd |
| Ni as $NiCl_2$ | 10 |
| $NH_4Cl$ | 50 |
| Dequest 2041 | 22 |
| benzaldehyde-o-sodium sulfonate | 1 |
| 2-butyne-1,4-diol | 0.1 |

The pH was adjusted to 8 with $NH_4OH$ and deposits exhibiting only very slight haze were obtained on brass panels at 120° F and current densities of 4, 10 and 20 ASF.

EXAMPLE 5

An aqueous palladium-nickel plating bath was prepared as follows:

| Component | Concentration - g/l |
|---|---|
| Pd as $Pd(NH_3)_2Cl_2$ | 10 |
| Ni as $NiSO_4$ | 20 |
| sulfamic acid | 40 |
| Dequest 2041 | 50 |
| benzaldehyde-o-sodium sulfonate | 2.5 - 3.0 |
| methylene-bis(naphthalene sodium sulfonate | 0.1 |

When adjusted to pH 9 with $NH_4OH$, bright deposits of low stress were obtained at 100° F and 20 ASF.

EXAMPLE 6

Baths identical to that of Example 2, but containing 60 to 120 g/l $NH_4Cl$ were employed to form a deposit on nickel pins. Thereafter, the pins were heat treated and swaged to form the pins into the desired form. Tests showed the adhesion and porosity of the surface to be excellent, even after cold forming.

What is claimed is:

1. A stable aqueous electroplating bath useful for the electrodeposition of palladium or palladium base alloys comprising palladosammine chloride in an amount of 0.1 to 50 g/l palladium, sulfonic acid in an amount of about 1.0 to 100 g/l, and at least 5 g/l of a phosphonic compound of the formula:

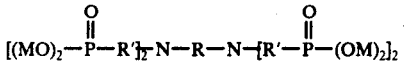

wherein R is an alkylene group of 2 - 6 carbon atoms, each R' is an alkylene group of 1 to 4 carbon atoms, and each M is a non-deleterious cationic moiety, said bath exhibiting a pH value of from 7.0–10.0.

2. The bath of claim 1 wherein R is ethylene, each R' is methylene and each M is independently selected from the cation group consisting of H, ammonium, alkali metal and alkyl groups of up to 4 carbon atoms.

3. The bath of claim 1 additionally containing at least one conducting or buffering salt.

4. The bath of claim 3 containing chloride salts to improve conductivity.

5. The bath of claim 4 containing $NH_4Cl$ as a conductive salt.

6. The bath of claim 5 additionally containing an ammonium phosphate compound.

7. The bath of claim 1 additionally containing sulfamic acid, or an alkali metal or ammonium salt thereof.

8. The bath of claim 1 additionally containing ammonium hydroxide.

9. The bath of claim 1 additionally containing an additive selected from the alloying metals and organic or inorganic brightening agents.

10. A process for obtaining a palladium containing deposit on a conductive surface in contact with the bath of claim 1 comprising electrolyzing said bath with the surface as cathode.

11. An aqueous electroplating bath for the electrodeposition of palladium, comprising:

| Component | Concentration |
|---|---|
| Ethylene diamine tetra-(methylphosphonic acid) | 5 g/l to solubility limit |
| $Pd(NH_3)_2Cl_2$ | 0.1 to 50 g/l |
| Sulfamic acid | 1 to 100 g/l |
| Ammonium chloride | 1 to 200 g/l |
| Ammonium monohydrogen phosphate | 1 to 100 g/l |
| Ammonium hydroxide | to pH 4.5 to 12. |

12. The bath of claim 11 comprising:

| Component | Concentration |
|---|---|
| Ethylene diamine tetra-(methylphosphonic acid) | 45 g/l |
| $Pd(NH_3)_2Cl_2$ | 1 to 10 g/l |
| Sulfamic acid | 40 g/l |
| Ammonium chloride | 50 to 150 g/l |
| Ammonium monohydrogen phosphate | 25 to 75 g/l |
| Ammonium hydroxide | to pH 6.5 to 10. |

* * * * *